US006108940A

United States Patent [19]

St. Louis

[11] Patent Number: 6,108,940

[45] Date of Patent: Aug. 29, 2000

[54] HEATER HOUSING FOR AN ELECTRIC CLOTHES DRYER

[75] Inventor: Robert Maurice St. Louis, St. Leonard, Canada

[73] Assignee: Camco Inc., Mississauga, Canada

[21] Appl. No.: 09/305,309

[22] Filed: May 5, 1999

Related U.S. Application Data

[63] Continuation-in-part of application No. 09/052,121, Mar. 31, 1998, Pat. No. 5,935,471.

[51] Int. Cl.[7] ..... F26B 11/02

[52] U.S. Cl. ..... 34/601; 34/602; 34/603; 34/604; 219/465.1; 219/532

[58] Field of Search ..... 34/108, 130, 595, 34/598, 600, 601, 602, 603, 604, 138, 139; 219/357, 375, 525, 465.1, 532, 537, 542

[56] References Cited

U.S. PATENT DOCUMENTS

| | | | |
|---|---|---|---|
| 3,154,281 | 10/1964 | Frank . | |
| 3,670,143 | 6/1972 | Zenz | 219/375 |
| 3,790,751 | 2/1974 | Kuhn | 219/525 |
| 3,799,387 | 3/1974 | Zenz | 220/18 |
| 3,846,619 | 11/1974 | Wightman et al. | 219/532 |
| 3,920,887 | 11/1975 | Kloos et al. | 174/148 |
| 3,935,376 | 1/1976 | Cooper et al. . | |
| 3,952,409 | 4/1976 | Allison et al. | 219/532 |
| 3,975,832 | 8/1976 | Mori et al. | 34/548 |
| 3,992,609 | 11/1976 | Alexander | 219/532 |
| 4,250,399 | 2/1981 | King | 219/532 |
| 4,392,052 | 7/1983 | Magnusson et al. | 219/532 |
| 4,546,554 | 10/1985 | Bullock et al. | 34/549 |
| 4,656,340 | 4/1987 | St. Louis | 219/532 |
| 4,700,495 | 10/1987 | Drews et al. | 34/133 |
| 4,848,567 | 7/1989 | Howard et al. | 206/332 |
| 4,994,654 | 2/1991 | St. Louis | 219/532 |
| 5,122,640 | 6/1992 | Holmes | 219/532 |
| 5,124,534 | 6/1992 | Williams et al. . | |
| 5,127,169 | 7/1992 | Ellingson | 34/603 X |
| 5,578,232 | 11/1996 | Engelke | 219/532 |
| 5,771,604 | 6/1998 | Wunderlich et al. | 34/603 |

FOREIGN PATENT DOCUMENTS

| | | | |
|---|---|---|---|
| 771787 | 11/1967 | Canada | 309/106 |

*Primary Examiner*—Stephen Gravini

[57] ABSTRACT

An electric clothes dryer has an irregular polygonal shaped rear wall where the apexes in the polygon align readily with the center of the heater housing to define positions where the electrical insulators are mounted to the heater housing rear wall. Raised land pads are formed from the rear wall of the heater housing at these locations and on which the insulators are mounted. The raised land pads further have radial slots that permit airflow from beneath the pad into the heater housing and across the insulator and the heating element. The apexes further provide an increased air gap for increased airflow radially across the electrical insulators. The heater housing has an air gap with the rear end head of the dryer drum which air gap is smaller adjacent the upper portions of the heater housing so as to reduce the chimney effect associated with the air heated in the heater housing.

9 Claims, 3 Drawing Sheets

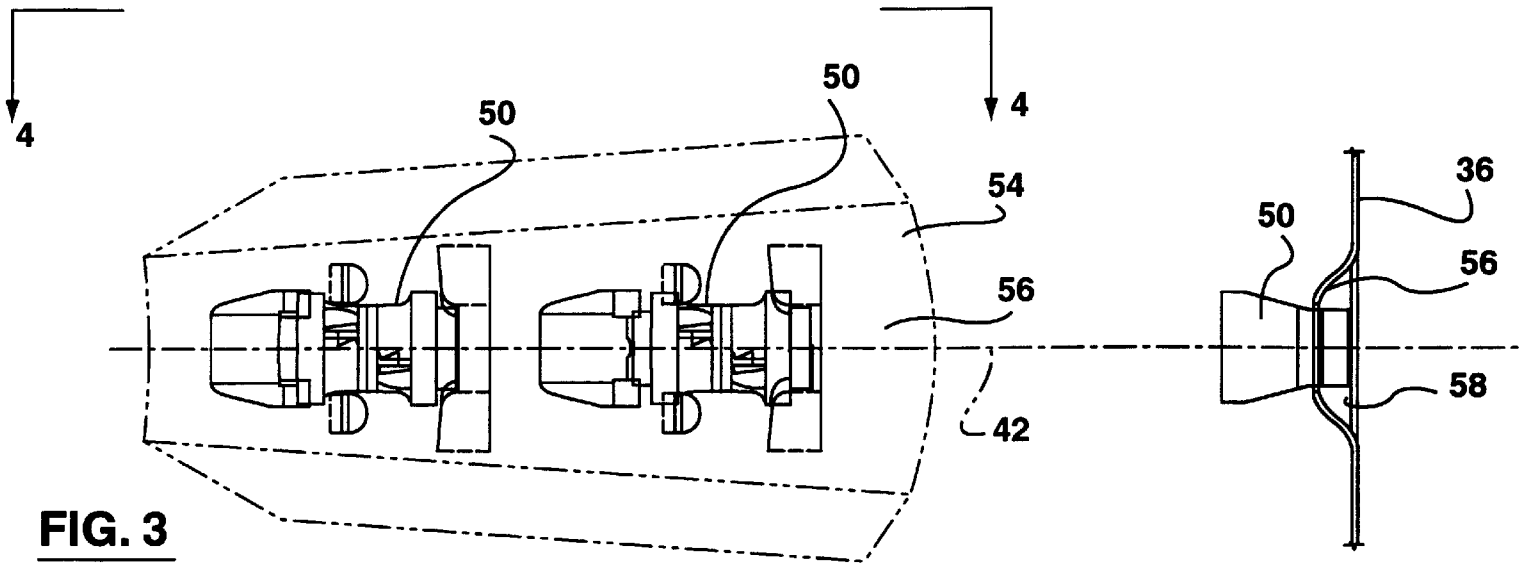
FIG. 3
FIG. 5
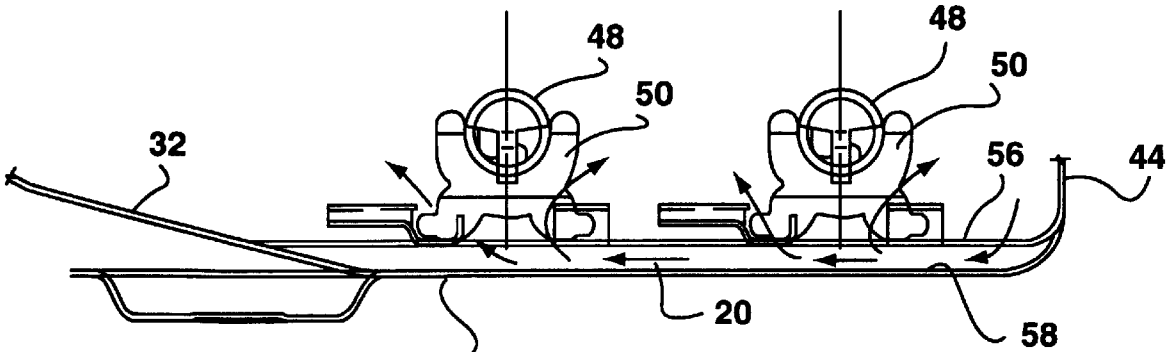
FIG. 4

HEATER HOUSING FOR AN ELECTRIC CLOTHES DRYER

RELATED APPLICATION

This application is a continuation-in-part of my U.S. patent application Ser. No. 09/052,121 filed Mar. 31, 1998 now U.S. Pat. No. 5,935,471 and entitled "Heater Coil Support and Mounting Bracket".

FIELD OF THE INVENTION

This invention relates to an electric clothes dryer having a heater housing that carries heating elements. In particular, this invention relates to a heater housing having improved air flow characteristics.

BACKGROUND OF THE INVENTION

Electric clothes dryers typically have a rotating drum which tumbles clothing as warm air passes through the drum. The drum has a wall having a plurality of perforations through which air may enter the drum. The air entering the drum through the rear wall is heated in a heater housing located behind the rear wall. My U.S. Pat. No. 4,994,654 issued Feb. 19, 1991 illustrates a heater housing onto which are mounted electrical coils through insulated brackets. Air is drawn in through the air gap between the heater housing and the rear wall of the dryer drum. The air is drawn over the electrical heating coils and in through the apertures in the rear wall of the dryer drum. As a result, air entering the dryer drum is heated for drying the clothes. In this patent, the heater housing is shown to be circular in shape and the insulating brackets are mounted directly to the rear wall of the diffuser dryer drum housing.

Warm spots associated with the airflow over the insulator brackets in the heater housing are known to occur. Further, convection also results in hot spots being located towards the top portion of the heater housing construction. Accordingly, it will be appreciated that there is a need to improve airflow to eliminate these hot spots or hotter regions within the heater housing.

SUMMARY OF THE INVENTION

It is an object of the present invention to provide an electric clothes dryer having a heater housing having improved air flow characteristics within the heater housing adjacent the location where electrical insulators are mounted to the rear wall of the heater housing.

It is another object of the present invention to provide a heater housing wherein the upper portions of the housing are less subject to a chimney effect resulting from the rising heat due to convection.

The present invention relates to an electric clothes dryer having a rotatable drum having with a rear end head. The rear end head has a plurality of apertures through which air flows into the drum. Mounted within the drum adjacent the rear end head is a heater housing which carries a series of electrical insulators to which are mounted electric heating coils. In accordance with one aspect of the present invention the heater housing has rear wall spaced from the rear end head which is slightly larger than the rear end head. The rear wall has a generally irregular polygonal shape defining a center and apexes. A plurality of radial lines extend from the center of each wall to each of the apexes. The electrical insulators are connected along these radial lines and the apexes create larger air gaps between the heater housing and the rear end head than at the other portions of the heater housing so that there is an increased air flow radially into the heater housing adjacent the location of the electrical insulators.

In accordance with another aspect of the present invention the electrical insulators are mounted on raised land pads formed from the rear wall of the heater housing. The raised land pads may be further provided with radially extending or directed slots through which air may pass beneath the land pad and up and across the insulator to thereby further cool the insulator. Further, the heating coils extending between insulators are spaced from the rear wall of the heater housing by the distance of the insulator and the raised land pad.

In accordance with yet another aspect of the present invention, the rear end head and the heater housing are orientated vertically defining top and bottom portions for the heater housing. The peripheral sidewall from the top portion of the heater housing is located closer to the rear end head then the remainder of the peripheral sidewall so as to define a narrower air gap adjacent the top portion of the heater housing. This limits the airflow in from the top portion resulting in more air rising from the lower portions of the heater housing being drawn through the aperture in the rear end head of the dryer drum.

In accordance with one aspect of the present invention there is provided an electric clothes dryer comprising a rotating drum having a rear end head and the rear end head having a plurality of apertures through which air flows into the drum. A heater housing is mounted in the dryer adjacent the rear end head. The heater housing has a rear wall spaced from the rear end head. The rear wall is larger than rear end head and the rear wall has a generally irregular polygonal shape has a center and apexes with a plurality of radial lines extending from the center of the rear wall to each of the apexes. The heater housing has an upstanding sidewall extending around the peripheral of the rear wall and towards the rear end head to define an air inlet gap of variable size therebetween though which air flows radially into the space between the heater housing and the rear end head and wherein the size of the air inlet gap is larger adjacent the apexes of the rear wall permitting for greater air flow through the air inlet gap adjacent the apexes. A plurality of electrical insulators are mounted to the rear wall along the defined radial lines. An electrical heating coil is mounted to the electrical insulators spaced from the rear wall of the heater housing and the rear end head wall of the dryer drum.

In accordance with another aspect of the present invention, there is provided an electric clothes dryer comprising a rotating drum having a rear end head and the rear end head having a plurality of apertures through which air flows into the drum. A heater housing is mounted in the dryer adjacent the rear end head. The heater housing has a rear wall spaced from the rear end head. The rear wall is larger than the rear end head. The heater housing has an upstanding sidewall extending around the peripheral of the rear wall and towards the rear end head to define an air inlet gap therebetween though which air flows radially into the space between the heater housing and the rear end head. The rear wall of the heater housing includes a series of raised land pads raised a predetermined height above the rear wall. A plurality of electrical insulators are mounted to the raised land pads. An electrical heating coil is mounted to the electrical insulators spaced from the rear wall of the heater housing by the insulator and the height of the raised land pad.

BRIEF DESCRIPTION OF THE DRAWINGS

For a better understanding of the nature and objects of the present invention, reference may be had to the accompanying diagrammatic drawings in which:

FIG. 3 is a partial plan view of a raised land pad;

FIG. 4 is a side view taken along lines 4—4 of FIG. 3; and,

FIG. 5 is an end view of FIG. 3.

DETAILED DESCRIPTION OF THE PREFERRED EMBODIMENT

Figure 1:
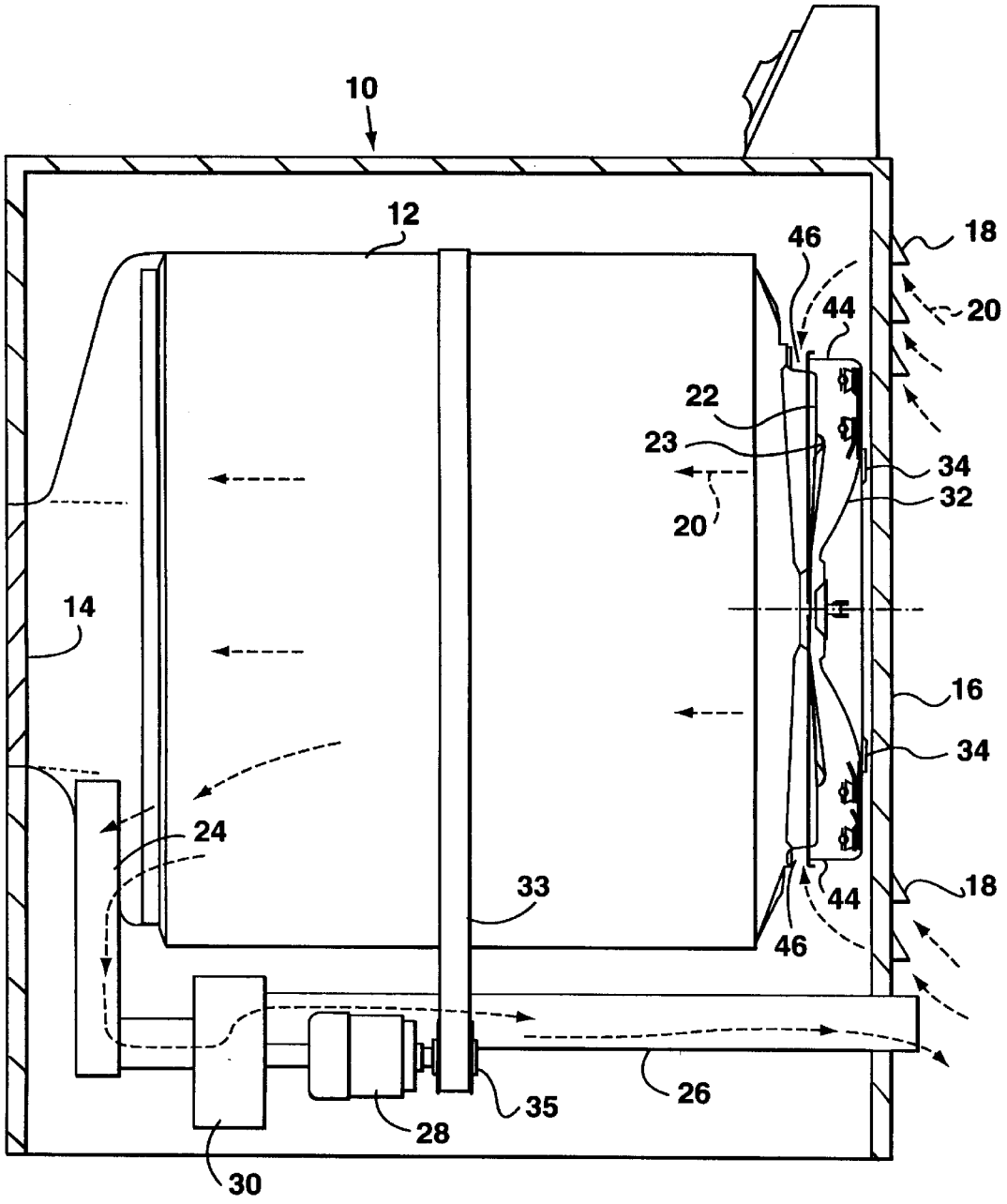
FIG. 1 is a view showing an electric clothes dryer having a rotating drum, rear end head and heater housing of the present invention.

Referring to FIG. 1 there is shown a clothes dryer 10 having a rotating drum 12 mounted therein. The rotating drum has an open front through which access can be gained through door 14 of the dryer 10 for the insertion and removal of clothing and other articles from the drum. The clothes dryer 10 has a rear panel 16 provided with a series or plurality of louvers 18 through which air may be drawn into the interior of the dryer 10. The airflow is shown by arrows 20 passing through the louvers, through a series of openings 23 in the rear end head 22 of the dryer drum 12 through front ducting 24 and out through exhaust ducting 26. Motor 28 draws or rotates fan 30 to draw the air 20 through the drum 12. The motor 28 through pulley 32 and belt 34 also causes the rotation of the dryer drum 12.

Figure 2:
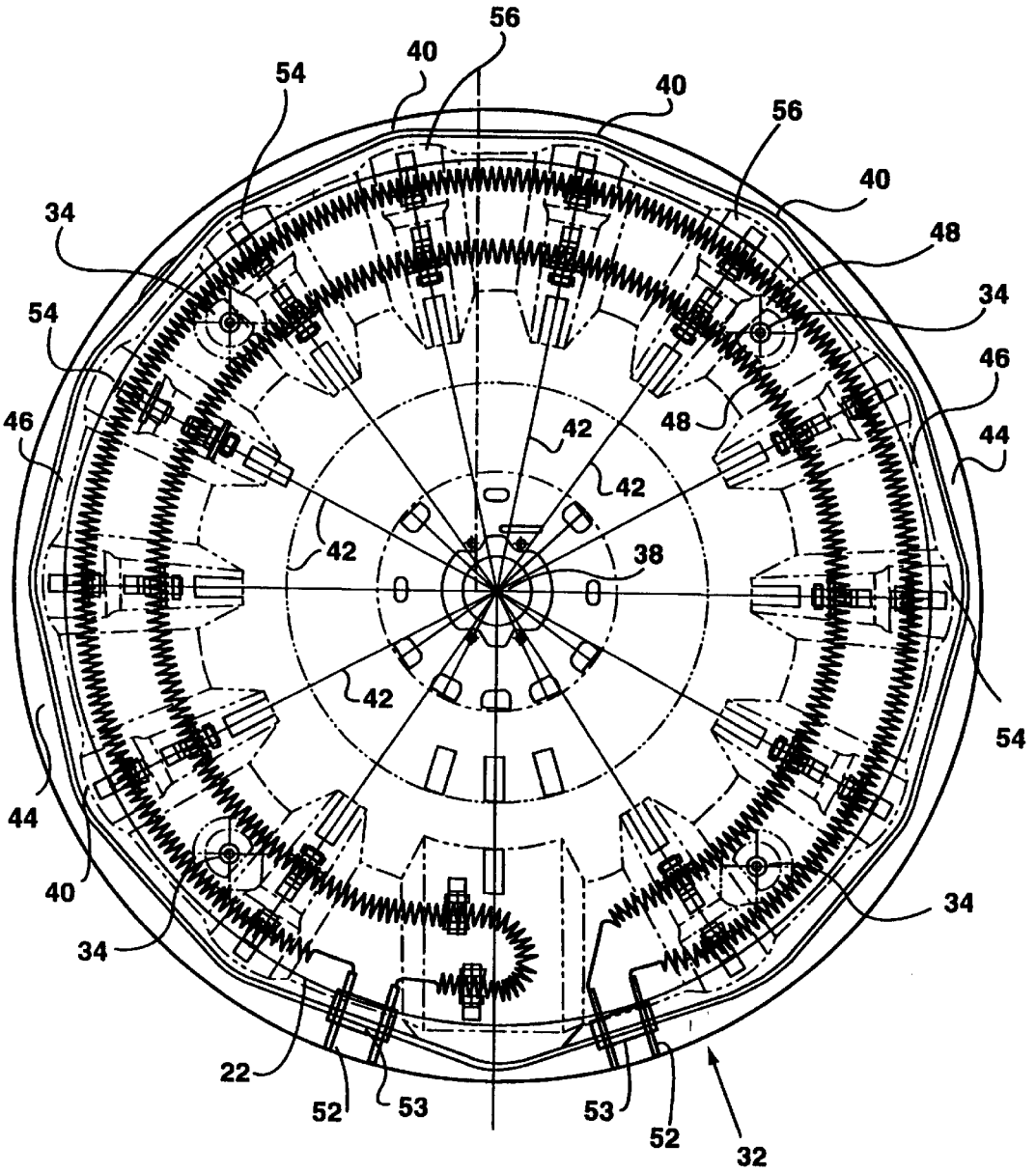
FIG. 2 is an elevation view showing heater housing.

A heater housing 32 is mounted by suitable bolts 34 to the rear panel 16 of the dryer 10. The heater housing 32 is adjacent the end head 22. The heater housing 32 has a rear wall 36 that is spaced from the rear end head 22. The rear wall 36 has a diameter which is greater than the rear end head 22 inner diameter and as a result the rear wall 36 is slightly larger than the rear end head 22. The rear wall 36 has a generally irregular polygonal shape (see FIG. 2) that has a center 38 and apexes 40. Radially extending lines 42 are defined between the center of the rear wall 36 and the apexes 40 at the periphery of the rear wall 36.

The heater housing has an upstanding sidewall 44 that extends around the periphery of the polygonal shaped rear wall 36. The upstanding sidewalls 44 further extend towards the rear end head 22. An air gap 46 of variable size extends between the upstanding sidewall 44 and the end head 22 of the dryer drum. Due to the polygonal shape of the rear wall 36 of the heater housing 32, a variable gap 46 is obtained wherein at the apexes 40, the gap 46 is larger in size than the gap 46 between the apexes 40. This permits for greater airflow through the air input gap 46 adjacent the apexes 40.

Helically wound heater coils 48 are mounted via electrical insulators 50 to the rear wall 36 of the heater housing 32. The coils 48 are spaced from the rear walls 36 and from the end head 22 of the dryer drum. The heater coils 48 are connected to a source of electrical supply through terminals 52 mounted through suitable insulators 54 in the sidewall 44. When electrical energy is fed through terminals 52 to coils 48, the coils warm heating air passing over the coils and towards the openings 23 in the end head 22 of the dryer drum 12. Because of the increased air gap 46 at the apexes 40, more air is drawn across the coil adjacent the insulator 53 which has been known to become a hot spot in the past. This increased airflow across the insulator 53 improves the operating characteristics of the heating assembly of this dryer.

As is shown in the drawing, the dryer drum 12 is rotatable about a horizontal axis, this being the case, the heater housing 32 and the end head 22 are orientated in a vertical direction. It will be seen from FIGS. 1 and 2 that the gap distance 46 at the top portion of the diffuser head pan 32 has a gap distance which is less than that shown at the side portions. Accordingly, less air is drawn from the top portion of the heater housing 32 when compared from air drawn from lower and side portions of the heater housing 32. This creates less of a chimney effect that may be associated with the orientation of the heater housing within the dryer 10.

Referring to FIGS. 2 through 5, the rear wall 36 of the heater housing 32 includes a series of radially extending raised land pads 54 which are stamped from the rear wall 36 of the heater housing 32. The pads 54 extend in the radial direction and provide a raised surface 56 onto which the insulators 50 are mounted. The raised portion 56 of the land pad 54 forms a radial slot 58 through which air flow 20 passes below the insulators from behind the insulators 50 across the heating coils 48 thereby cooling the insulator 56 as the coils pass over the insulator 50.

It will be seen from FIG. 4, that the coils 58 are supported above the floor or rear wall 36 of the heater housing 32 by the raised land pad 54 and the insulator 50.

It will be seen that the polygonal shape of the rear wall of the heater housing 32 and the raised land pads 54 formed from the rear wall 36 of the heater housing 32 with openings stamped in the top surface result in improved airflow over the insulator holding the heating coils 48.

What I claim is:

1. An electric clothes dryer comprising:

a rotating drum having a rear end head and the rear end head having a plurality of apertures through which air flows into the drum;

a heater housing mounted in the dryer adjacent the rear end head, the heater housing having a rear wall spaced from the rear end head, the rear wall being larger than rear end head, and the rear wall having a generally irregular polygonal shape having a center and apexes with a plurality of radial lines extending from the center of the rear wall to the apexes, the heater housing having an upstanding sidewall extending around the peripheral of the rear wall and towards the rear end head to define an air inlet gap of variable size therebetween though which air flows radially into the space between the heater housing and the rear end head, and wherein the size of the air inlet gap is larger adjacent the apexes of the rear wall permitting for greater air flow through the air inlet gap adjacent the apexes;

a plurality of electrical insulators mounted to the rear wall along the defined radial lines; and, an electrical heating coil mounted to the electrical insulators spaced from the rear wall of the heater housing and the rear end head wall of the dryer drum.

2. The electric clothes dryer of claim 1 wherein the dryer drum is rotatable about a horizontal axis, the rear end head and the heater housing are orientated vertically defining top and bottom portions for the heater housing, and the peripheral sidewall extending from the top portion of the heater housing being closer to the rear end head than the remainder of the peripheral sidewall to define a narrower air gap adjacent at the top portion of the heater housing.

3. The electric clothes dryer of claim 1 wherein the rear wall of the heater housing includes a series of radially extending raised land pads positioned along the radial lines, and said insulators being mounted to the raised land pads.

4. The electric clothes dryer of claim 3 wherein each of the raised land pads has at least one aperture permitting air to flow from the dryer into the heater housing close to the insulators to cool the insulators.

5. An electric clothes dryer comprising:

a rotating drum having a rear end head and the rear end head having a plurality of apertures through which air flows into the drum;

a heater housing mounted in the dryer adjacent the rear end head, the heater housing having a rear wall spaced from the rear end head, the rear wall being larger than rear end head, the heater housing having an upstanding sidewall extending around the peripheral of the rear wall and towards the rear end head to define an air inlet gap therebetween though which air flows radially into the space between the heater housing and the rear end head, the rear wall of the heater housing including a series of raised land pads raised a predetermined height above the rear wall;

a plurality of electrical insulators mounted to the raised land pads; and, an electrical heating coil mounted to the electrical insulators spaced from the rear wall of the heater housing by the insulator and the height of the raised land pad.

6. The electric clothes dryer of claim 5 wherein each of the raised land pads has at least one aperture permitting air to flow from the dryer into the heater housing close to the insulators to cool the insulators.

7. The electric clothes dryer of claim 5 wherein the rear wall has a generally irregular polygonal shape having a center and apexes, and defining a plurality of radial lines extending from the center of the rear wall to each of the apexes, and the raised land portions being located along the radial lines.

8. The electric clothes dryer of claim 7 wherein each of the raised land pads has at least one aperture permitting air to flow from the dryer into the heater housing close to the insulators to cool the insulators.

9. The electric clothes dryer of claim 5 wherein the dryer drum is rotatable about a horizontal axis, the rear end head and the heater housing are orientated vertically defining top and bottom portions for the heater housing, and the peripheral sidewall extending from the top portion of the heater housing being closer to the rear end head than the remainder of the peripheral sidewall to define a narrower air gap adjacent at the top portion of the heater housing.

* * * * *